US006119315A

United States Patent [19]

Gay

[11] Patent Number: 6,119,315

[45] Date of Patent: Sep. 19, 2000

[54] BUTTON CLASP

[75] Inventor: Jacques H. Gay, route de Vandeouvres, Switzerland

[73] Assignee: Vacheron & Constantin S.A., Geneva, Switzerland

[21] Appl. No.: 09/029,599

[22] PCT Filed: May 26, 1997

[86] PCT No.: PCT/CH97/00214

§ 371 Date: Jun. 5, 1998

§ 102(e) Date: Jun. 5, 1998

[87] PCT Pub. No.: WO98/00042

PCT Pub. Date: Jan. 8, 1998

[30] Foreign Application Priority Data

Jul. 1, 1996 [CH] Switzerland ..... 1634/96

[51] Int. Cl.[7] ..... A44C 5/24

[52] U.S. Cl. ..... 24/68 J; 24/71 J; 24/265 WS

[58] Field of Search ..... 24/68 J, 69 J, 24/70 J, 71 J, 68 E, 68 T, 71 R, 265 WS, 265 BC, 265 EC, 265 B, 616, 625

[56] References Cited

U.S. PATENT DOCUMENTS

| | | | |
|---|---|---|---|
| 2,532,840 | 12/1950 | Gaun | 24/71 R |
| 4,546,522 | 10/1985 | Gygax | 24/71 J |
| 4,928,359 | 5/1990 | Gagnebin | 24/71 J |
| 5,187,838 | 2/1993 | Fontana | 24/71 J |
| 5,305,617 | 4/1994 | Fontana | 24/265 WS X |
| 5,579,559 | 12/1996 | Ferrario | 24/71 J |
| 5,699,590 | 12/1997 | Erard et al. | 24/71 J |

FOREIGN PATENT DOCUMENTS

| | | |
|---|---|---|
| 0 115 740 | 8/1984 | European Pat. Off. . |
| 0 620 986 | 10/1994 | European Pat. Off. . |
| 0 509 938 | 10/1995 | European Pat. Off. . |
| 1 541 115 | 10/1968 | France . |
| 2 723 824 | 3/1996 | France . |
| 604 598 | 9/1978 | Switzerland . |
| 684 151 | 7/1994 | Switzerland . |

*Primary Examiner*—Anthony Knight
*Assistant Examiner*—Robert J. Sandy
*Attorney, Agent, or Firm*—Young & Thompson

[57] ABSTRACT

A folding clasp for a wrist-watch, having at least one folding arm (1, 2) articulated with respect to a base plate (3) and a locking device (4) located on the base plate (3). The locking device (4) includes a mobile part (4.5) permitting a locking with an inclined end face (1.1, 2.1) of the at least one folding arm (1, 2) folded down on displacing the mobile part (4.5) in plane (TT') substantially perpendicular to the opening/closing plane (00') of the at least one folding arm (1, 2).

14 Claims, 6 Drawing Sheets

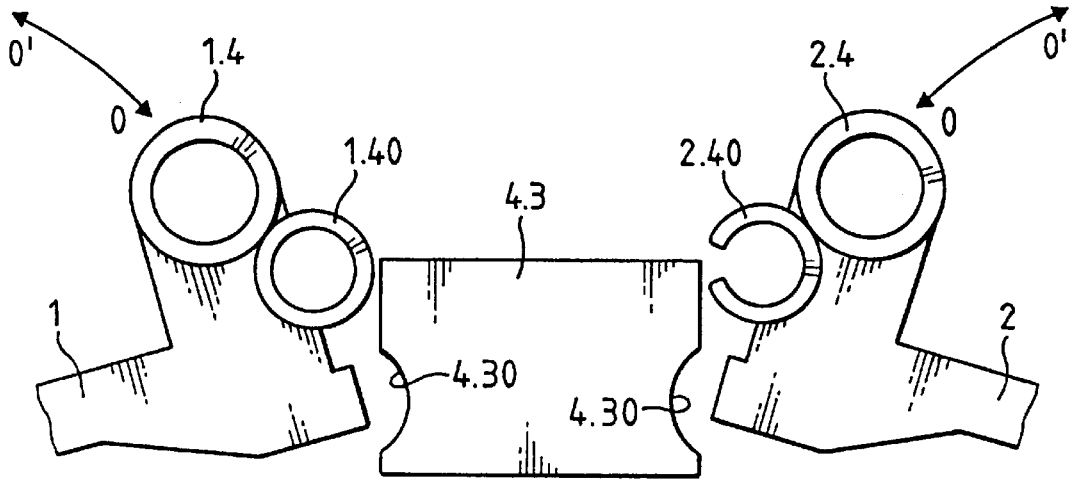
FIG. 5a
FIG. 5b
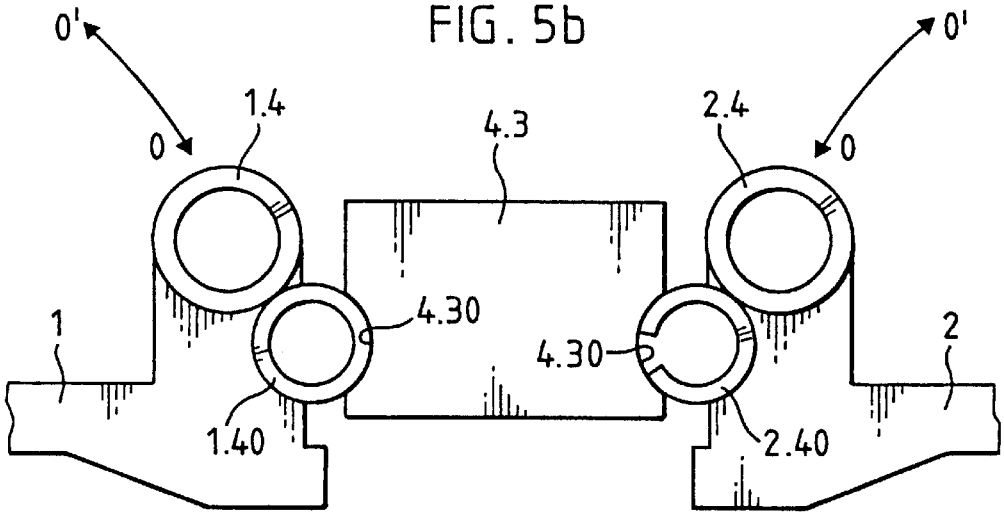

BUTTON CLASP

BACKGROUND OF INVENTION

The invention relates to fasteners more particularly intended to equip a fastener having a clasp for a watch strap in accordance with the claims.

Fasteners having a folding, snap-on clasp with or without an articulated, folding arm are known. In exemplified manner, EP 509,938 describes a folding clasp comprising two folding arms articulated to the ends of a central cover or stretcher. Each arm has a concavity permitting a locking by compressing said concavity on a rod or pin of the central cover. This notching device must be accurately manufactured in order to function correctively. It has proved disadvantageous that the limited elasticity, one-piece arms and the concavities lose their flexibility under the effect of a repeated compression.

EP 115,740 discloses another tuning fork-system, folding, snap-on clasp, which as a more stable construction and has large friction surface in order to bring about the notching of the folding arms. Mention is made of the significant force necessary for opening or closing the watch strap. This constitutes another disadvantage, because the user can damage his nails on activating the groove.

A third disadvantage relates to the reliability and security of known fasteners having a folding, snap-on clasp. The locking forces are difficult to regulate and have a risk of the clasp opening in an untimely manner.

SUMMARY OF THE INVENTION

The object of the invention is therefore to provide a solution to these problems by creating a generally applicable folding clasp, e.g. for a wrist-watch, which has a particularly compact construction compatible with known, proven manufacturing methods. This object is achieved by the invention, as defined in the claims.

BRIEF DESCRIPTION OF THE DRAWINGS

The invention will now be described relative to the attached drawings, wherein show:

FIGS. 5*a* & 5*b* A diagrammatic view of a detail of the opening/closing mechanism of a preferred embodiment of a folding clasp.

DESCRIPTION OF THE PREFERRED EMBODIMENTS

Figure 1A:
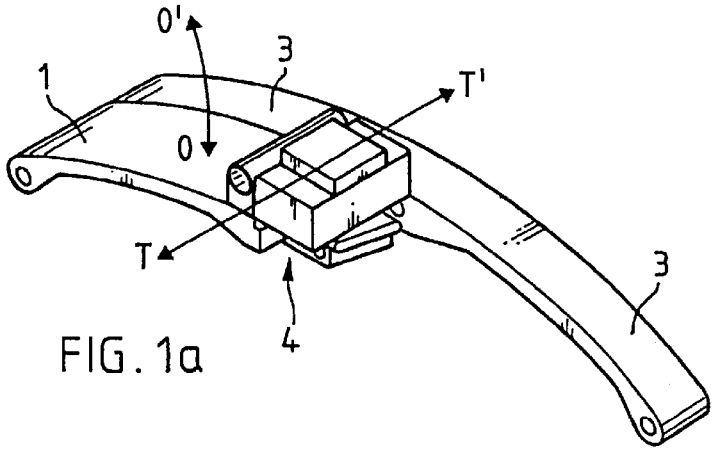
FIGS. 1*a* to 1*c* A perspective view of a detail of a preferred embodiment of a folding clasp.
Figure 1B:
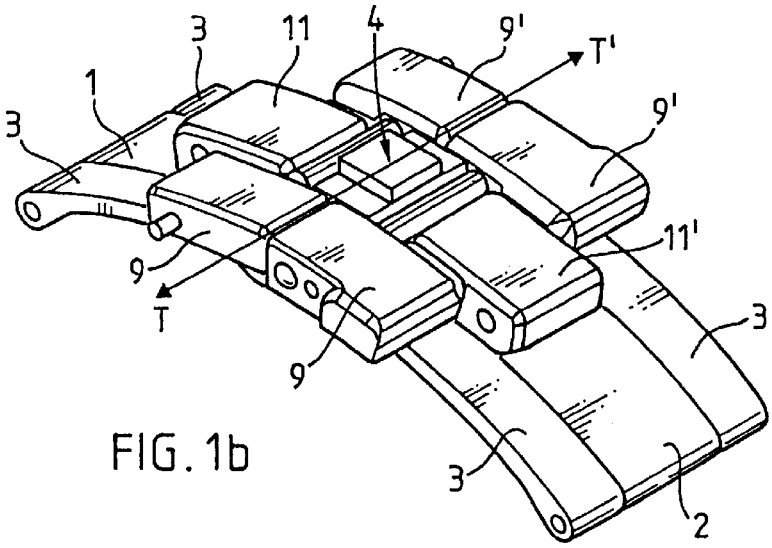
Figure 1C:
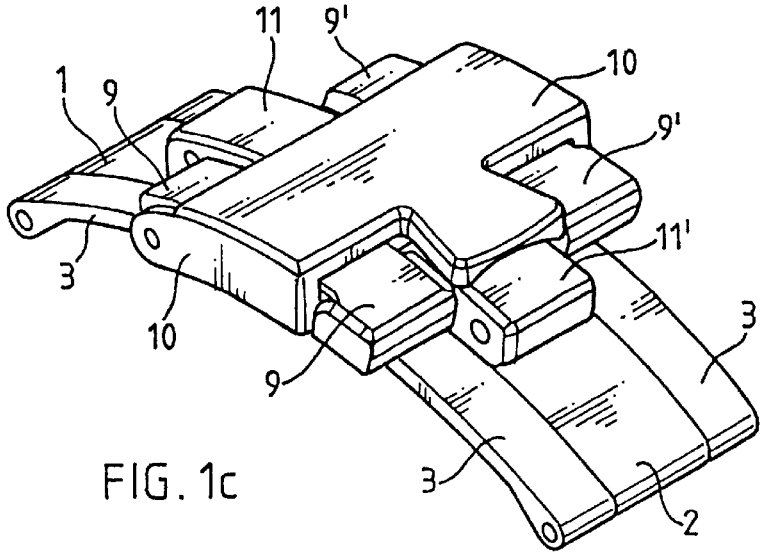

FIGS. 1*a* to 1*c* and 2*a*, 2*b* show a perspective, exploded view of a detail of preferred embodiments of a folding clasp. Said folding clasp comprises at least one folding arm 1, 2 articulated in an opening/closing plane 00' with respect to base plate 3. Said at least one folding arm 1, 2 is detachable about at least one articulation axis with at least on hinge pin 1.5, 2.5. Preferably, the clasp has two folding arms 1, 2 detachable about two articulation axes with two hinge pins 1.5, 2.5. Whilst remaining within the scope of the invention, it is obviously possible to have a clasp with only one folding arm.

Figure 2A:
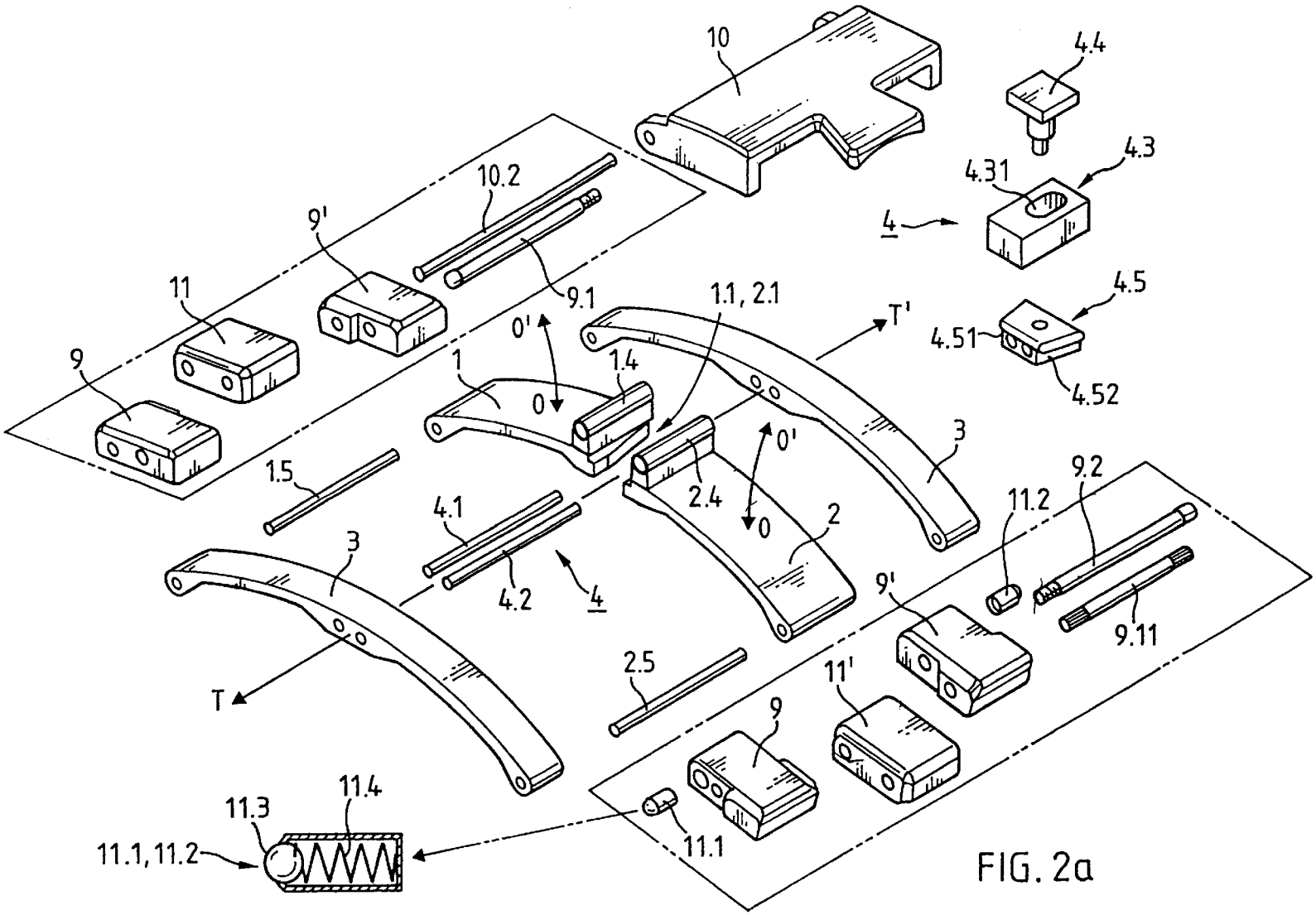
FIGS. 2*a* & 2*b* An exploded view of a detail of two preferred embodiments of a folding clasp.
Figure 2B:
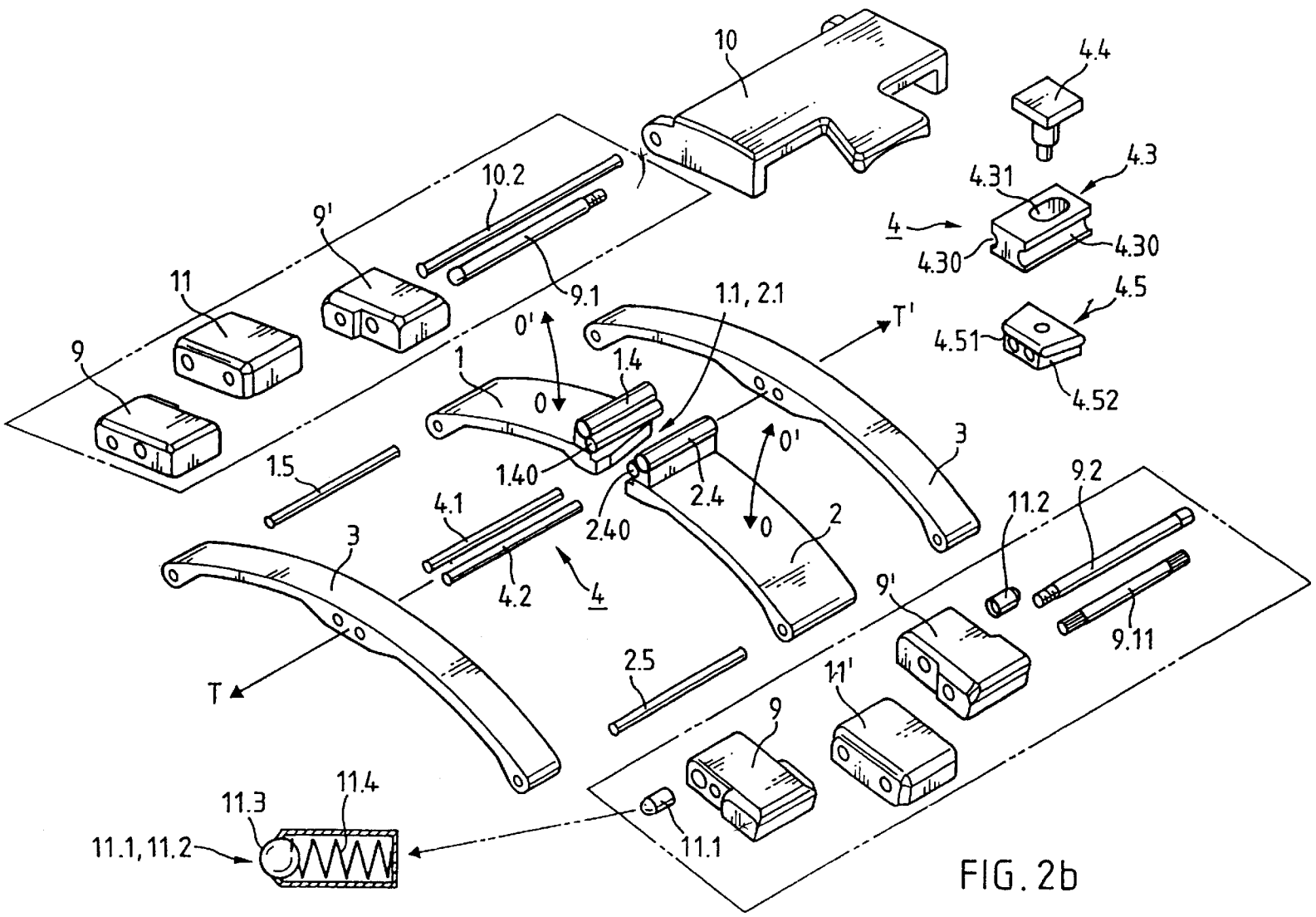

The folding clasp is characterized by a locking means 4 arranged on the base plate 3. FIGS. 2*a* and 2*b* make a distinction between two preferred embodiments of a folding clasp. A first embodiment according to FIG. 2*a* show a locking performed essentially by a mobile part 4.5 of the locking means 4 with at least one inclined end face 1.1, 2.1 of said at least one folding arm 1, 2 folded down onto the base plate 3. This locking will be described in greater detail relative to FIGS. 3*a* and 3*b*. Another embodiment according to FIG. 2*b* also shows an initial locking performed by a guide part 4.3 of the locking means 4 with at least one cylindrical rod 1.40, 2.40 of said at least one folding arm 1, 2 folded down onto the base plate 3. This initial locking will be described in greater detail relative to FIGS. 5*a* and 5*b*. Said two lockings are complimentary. In particular, the initial locking is optional and it is possible, whilst remaining within the scope of the invention, to manufacturing a clasp with or without initial locking.

Said locking of the mobile part 4.5 with at least one inclined end face 1.1, 2.1 takes place by displacing said part 4.5 in a plane TT' substantially perpendicular to the opening/closing plane 00' of said at least one folding arm 1, 2. Preferably, the plane TT' is perpendicular (lateral) to the longitudinal direction of the clasp and respectively a strap of a wrist-watch. In a preferred construction, said mobile part 4.5 slides on at least one lateral spindle 4.1, 4.2 of the locking means 4. In order that said mobile part 4.5 is easily accessible, said locking means 4 comprises a button 4.4 firmly fixed to said mobile part 4.5. Said locking means 4 also comprises at least one guide part 4.3 having an elongated opening 4.31 in the direction of the plane TT', so that a portion of the button 4.4 that is located within said opening 4.31 is guided with clearance and maintained in place during the locking of said at least one folding arm 1, 2.

Said initial locking of the guide part 4.3 of the locking means 4 with at least one cylindrical rod 1.40, 2.40 takes place by displacing said at least one folding arm 1, 2 in the opening/closing plane 00'. Preferably, a cylindrical rod 1.40, 2.40 is fixed on the side of a fastening 1.4, 2.4 of two folding arm 1, 2. By folding down each of the folding arms 1, 2 onto the base plate 3, two cylindrical rods 1.40, 2.40 perform a first ratching or initial locking with recesses 4.30 of the guide part 4.3. This preferred embodiment in all circumstances guarantees a first ratching or initial locking of the cylindrical rods 1.40, 2.40 of the folding arms 1, 2 with the guide part 4.3 of the locking means 4 prior to the locking of the inclined end faces 1.1, 2.1 of the folding arms 1, 2 with the mobile part 4.5 of the locking means 4.

Figure 3A:
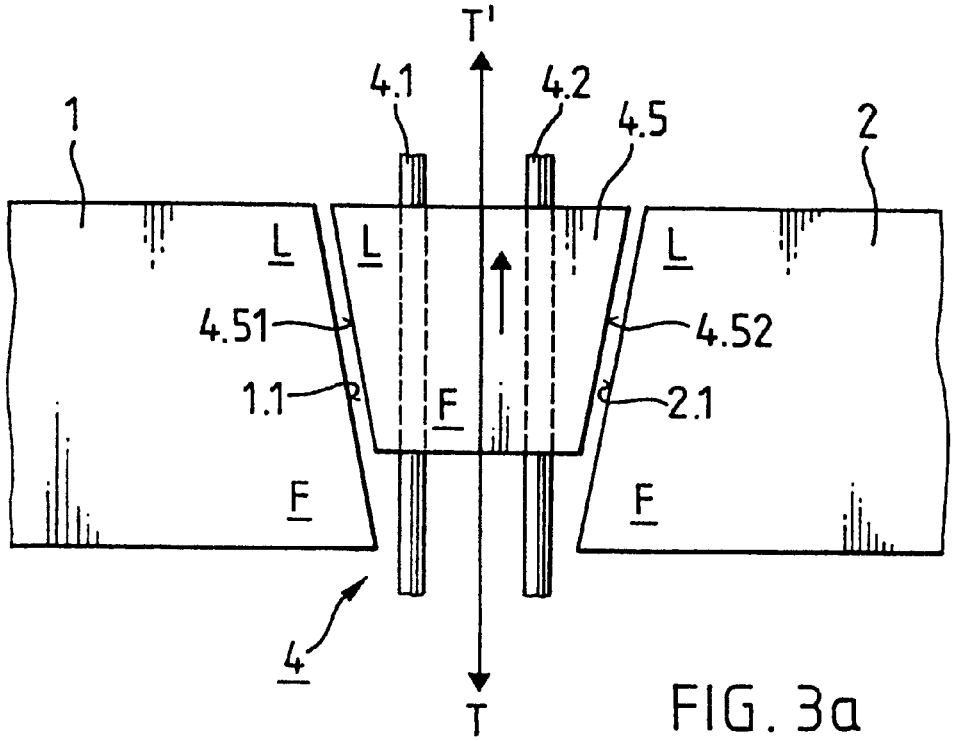
FIGS. 3*a* & 3*b* A diagrammatic plan view of a detail of the opening/closing mechanism of a preferred embodiment of a folding clasp.
Figure 3B:
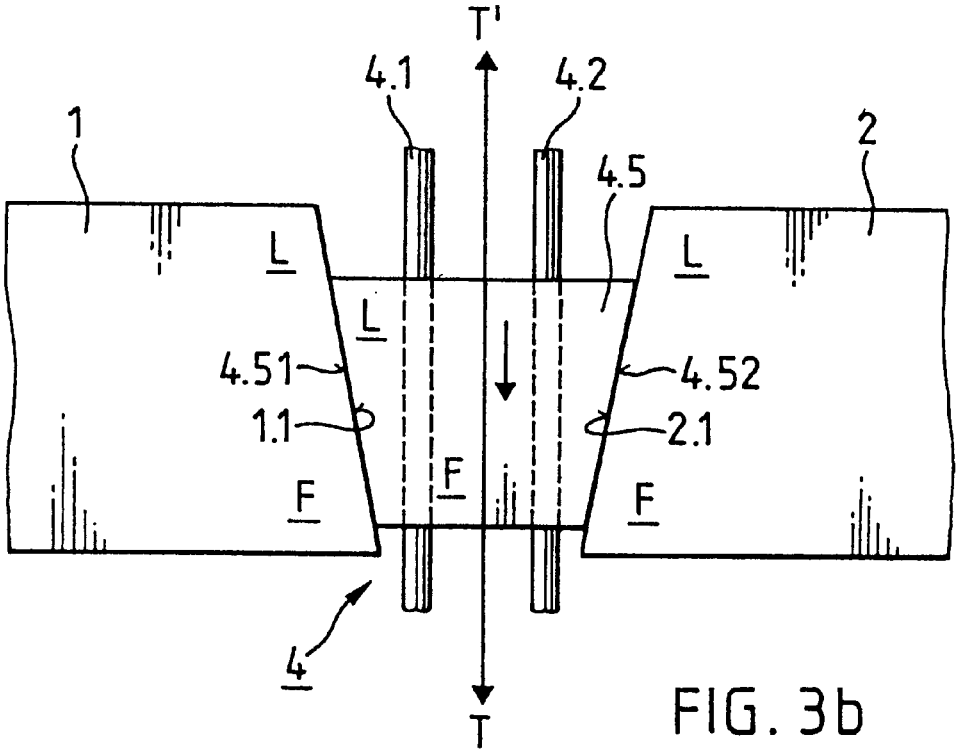

FIGS. 3*a* and 3*b* show in a diagrammatic plan view a detail of the opening/closing mechanism of the folding clasp. An inclined end face 1.1, 2.1 of said at least one folding arm 1, 2 and at least one corresponding, inclined end face 4.51, 4.52 of said mobile part 4.5 are in the form of a freed or conical Vs. Said freed or conical, V-shaped, inclined end faces 1.1, 2.1, 4.51, 4.52 are arranged under a constant inclination angle relative to the plane TT', so that their wide, conical side L corresponds to an unlocking position of the clasp (cf. FIG. 3*a*) and their narrow, conical side F corresponds to a locking position of the clasp (cf. FIG. 3*b*). Preferably, the inclined end faces 1.1, 2.1, 4.51, 4.52 are planar. Locking takes place under the effect of a nipping of the mobile part 4.5 against the at least one inclined end face 1.1, 2.1 of said at least one folding arm 1, 2 in the locking position of the narrow, conical side F.

This locking mechanism is quasi-binary. The mobile part 4.5 is like a small carriage sliding on at least one spindle 4.1, 4.2. By displacing the button 4.4 laterally under the effect of a small locking/unlocking force, the locking means 4 is either in the unlocked position of the wide, conical side L (cf. FIGS. 3*a* and 4*a*), or in a locked position of the narrow, conical side F (cf. FIGS. 3*b* and 4*b*). In the unlocked position, the mobile part 4.5 is slightly nipped beneath the guide part 4.3 permitting the maintaining in the unlocked position. This can take place by means of an oversize beneath the guide part 4.3. On opening said at least one folding arm 1, 2, the inclined end faces 1.1, 2.1 are slightly ratched with the corresponding, inclined end faces 4.51, 4.52 of the mobile part 4.5. This ensures that the mobile part 4.5 is entirely in the unlocked position prior to the opening of said at least one folding arm 1, 2.

FIGS. 5*a* and 5*b* are a diagrammatic view of another detail of the opening/closing mechanism of the folding clasp. A cylindrical rod 1.40, 2.40 of said at least one folding arm 1, 2 and at least one corresponding recess 4.30 of the guide part 4.3 are arranged in such a way that during a displacement of said at least one folding arm 1, 2 in an opening/closing plane 00', an initial locking takes place by the ratching of each of said cylindrical rods 1.40, 2.40 in a recess 4.30. Preferably, the clasp comprises two folding arms 1, 2 and each folding arm 1, 2 is provided with a cylindrical rod 1.40, 2.40. Preferably, a guide part 4.3 is provided and has two recesses 4.30 on the side of the folding arms 1, 2. The said recesses 4.30 are adapted to the geometrical shape of the cylindrical rods 1.40, 2.40. Without passing outside the scope of the invention, it is possible to provide different geometrical shapes, e.g. oval or even square rods and/or recesses. In particular, the cylindrical rods 1.40, 2.40 can be in the form of thin-walled tubes. Solid or recessed rods forming elastic tubes can be slotted, e.g. in their longitudinal direction (cf. e.g. the cylindrical rod 2.40 in FIGS. 5*a* and 5*b*). The application of slots is optional and it is possible to have elastic tubes or rods which are not slotted (cf. e.g. the cylindrical rod 1.40 in FIGS. 5*a* and 5*b*). These examples are shown in exemplified manner. The application of one or more slots to a cylindrical rod or an elastic tube permits a variation of the elasticity of the cylindrical rods or elastic tubes. It is obvious that the shape of such slots is not limited to linear slots in the longitudinal direction (helical, spiral or bias shapes are also possible) and the slots do not have to extend over the entire length of the cylindrical rods or elastic tubes. Such elastic tubes are preferably metallic and their thin wall preferably has a thickness of 0.15 mm. For a smaller thickness, the maximum bending stress would become excessive (the deformation force is too high and ratching becomes difficult), whereas for a greater thickness, the elastic constant of an elastic tube becomes excessive (the thin wall deforms beyond the reversible elastic limit and ratching is not well accentuated). Thus, for an elastic tube manufactured with a metallic material, e.g. an elastic tube made from stainless steel, a thickness of 0.15 mm represents an ideal choice, permitting both a well defined ratching or closing force (without being excessive or inadequate), whilst guaranteeing an easy machining of the locking means. A slotted rod and/or a slotted tube given additional degree of freedom to the initial locking. The quality of a clasp is not solely defined by its purely technical characteristics, but also by the impression which it makes on the user. Unlike in the case of known clasps, which do not use such an initial locking with cylindrical rods or elastic tubes and with a different pairing of materials, it is possible to individually regulate the forces and in particular adjust the ratching characteristics of the folding clasp. By e.g. replacing the tube by another thicker or thinner or more or less elastic tube, it is possible to individually regulate the ratching response, i.e. the ratio between the hardness and speed of ratching. Such a regulation is an important criterion for the user, comparable to the elegance and fineness of the clasp. The speed with which the clasp can be opened and closed can give an agreeable impression. This criterion often plays a decisive part, e.g. when buying a watch having such a folding clasp.

Preferably, the cylindrical rods 1.40, 2.40 are located close to the fastenings 1.4, 2.4. For example, the rods 1.40, 2.40 are welded to the fastenings 1.4, 2.4. Obviously other fixing means are possible without passing outside the scope of the invention. This position at the end of the folding arms 1, 2 always permits a first ratching or initial locking of the cylindrical rods 1.40, 2.40 of the folding arms 1, 2 with the guide part 4.3 of the locking means 4 prior to the locking of the inclined end faces 1.1, 2.1 of the folding arms 1, 2 with the mobile part 4.5 of the locking means 4. This position of the cylindrical rods 1.40, 2.40, half hidden by the fastenings 1.4, 2.4, is particularly esthetic and refined, which is desired by the user. FIG. 5*a* shows this initial locking prior to the ratching of the cylindrical rods 1.40, 2.40 in the recesses 4.30, whilst FIG. 5*b* shows the cylindrical rods 1.40, 2.40 after ratching in recesses 4.30. Preferably, the guide part 4.3 is firmly fixed to the base plate 3. In order to effect said initial ratching, the folding arms 1, 2 can be elastic in order to allow the more or less elastic cylindrical rods 1.40, 2.40 to pass beyond the projecting edge of the recesses 4.30. With the knowledge of the present invention, the expert can obviously produce other opening/closing mechanisms permitting such an initial locking with participating elements with a different mutual positioning.

Figure 4A:
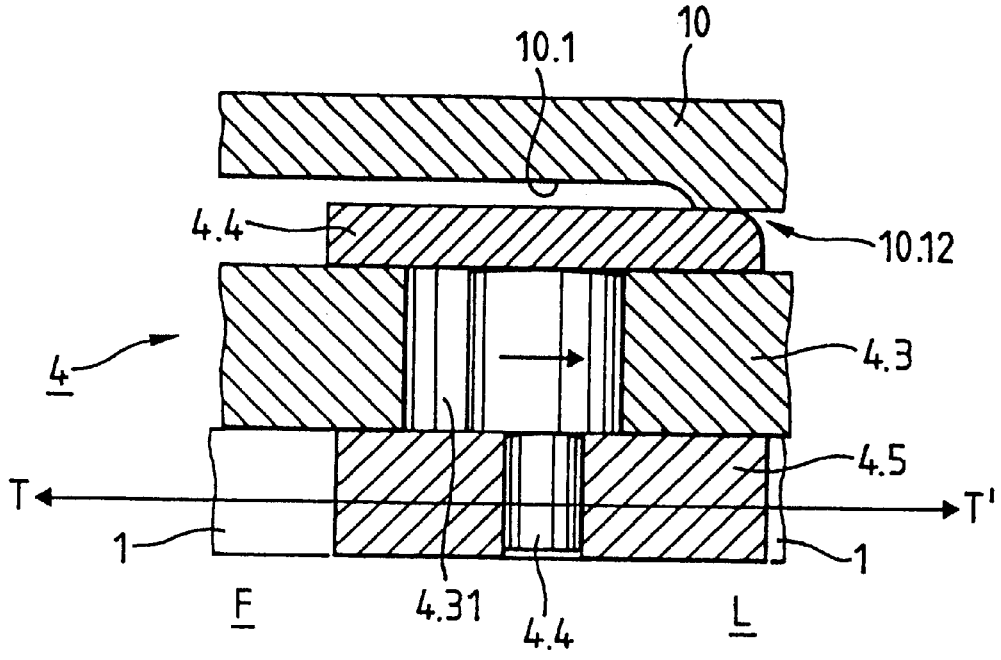
FIGS. 4*a* & 4*b* A diagrammatic view of a detail of a security system of the locking of a preferred embodiment of a folding clasp.
Figure 4B:
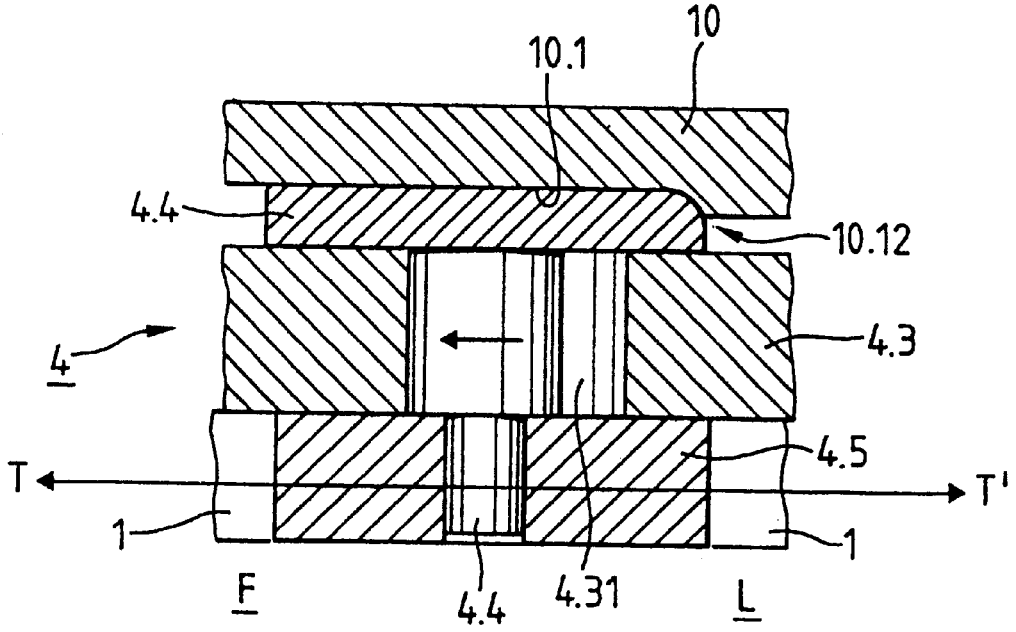

FIGS. 4*a* and 4*b* show a view of a detail of a folding clasp security locking system. Preferably, a first folding arm 1 comprises a cover 10 articulated with respect to said first folding arm 1. Said cover 10 is detachable about an articulation axis with a hinge pin 10.2. Said cover 10, folded down onto the locking means 4, permits a security of the locking of said at least one folding arm 1.2 which is of a complimentary nature. In particular, this security of the locking is optional and, whilst remaining within the scope of the invention, it is possible to produce a clasp with or without said security.

The cover 10 comprises an asymmetrical bottom 10.1, which is equipped with a boss 10.12 on the wide, conical side L of the inclined end faces 1.1, 2.1, 4.51, 4.52 (cf. FIGS. 1*a* to 3*b*) corresponding to an unlocking position of the clasp (cf. FIG. 4*a*) and said asymmetrical bottom 10.1 is recessed on the narrow, conical side F of said inclined end faces 1.1, 2.1, 4.51, 4.52 corresponding to a locking position of the clasp (cf. FIG. 4*b*), so that said asymmetrical bottom 10.1 of a folded down cover 10 secures the bottom 4.4 on the narrow, conical side F of said inclined end faces 1.1, 2.1, 4.51, 4.52 corresponding to a locking position of the clasp.

Said locking mechanism is characterized by a double function security. The cover 10 with the asymmetrical bottom 10.1 guarantees that it is not possible to turn the cover 10 down onto a locking means 4 in the unlocked position of the wide, conical side L (cf. FIGS. 3*a* and 4*a*), because the button 4.4 would serve as an obstacle to the boss 10.12 of the cover 10 and the latter reinforces the locking of the locking means 4 in the locked position of the narrow, conical side F (cf. FIGS. 3*b* and 4*b*), whilst preventing an untimely opening of the clasp.

It is obviously possible, whilst remaining within the scope of the invention, to produce a clasp with a cover having a boss with a shape such that, on folding down said cover, with the locking means in the unlocked position is quasi-automatically displaced (auto-guidance) into a locked position. With the knowledge of the present invention, the expert can implement numerous similar constructions.

Said folded down cover 10 is retained by ratching with at least one fixing means located on a second folding arm 2 (cf. FIGS. 2*a* and 2*b*) or on the base plate 3. Preferably, two fixing means 11.1, 11.2 are provided and each fixing means 11.1, 11.2 comprises a box containing a ball 11.3 arranged at one end of a rectilinear spring 11.4. The other end of the spring 11.4 is fixed to the bottom of the box. Such a fixing means 11.1, 11.2 is located within a guide bush of a second folding arm 2 (cf. FIGS. 2*a* and 2*b*) or the base plate 3, so that the balls 11.3 project beyond the guide bush and exert a fixing force on the turned down cover 10. The turned down cover 10 is fixed by spring force of the rectilinear springs 11.4. It is obviously possible to use other known fixing means without passing outside the scope of the invention.

The folding clasp is implemented with a minimum number of elements, which can be easily replaced or adjusted. The locking/unlocking force can easily be adjusted by changing (increasing/decreasing) the inclination angle of the inclined end faces 1.1, 1.2, 4.51, 4.52 shaped like freed or conical Vs (cf. FIGS. 3*a* and 3*b*).

The folding clasp is characterized by a particularly simple and reliable opening/closing mechanism. The displacement of the locking means 4 in the plane TT' does not give rise to wear of said notching device. The folding clasp is preferably metallic.

Finally, the folding clasp can be attached to the ends of a flexible link strap of a wrist-watch. Such links 9, 9', 11, 11' of two-piece straps are shown in FIGS. 2*a* and 2*b*. Preferably, the driven in, knurled spindles 9.11 hold together the links 9, 9', 11, 11'. Preferably, screws 9.1, 9.2 are provided for fixing the two-piece straps to fastenings 1.4, 2.4 of the folding arms 1, 2.

What is claimed is:

1. A folding clasp having two folding arms articulated with respect to a base plate, locking means placed on the base plate, said locking means comprising a mobile part permitting a locking with inclined end faces of said folding arms by displacing said mobile part in a first plane substantially perpendicular to an opening/closing plane of said folding arms, wherein said inclined end faces of said folding arms and at least one corresponding inclined end face of said mobile part are conical Vs, and wherein the inclined end faces in the form of conical Vs are arranged under a constant inclination angle relative to the first plane, so that wide, conical sides of the inclined end faces correspond to an unlocking position of the clasp and narrow conical sides of the inclined end faces correspond to a locking position of the clasp.

2. A folding clasp according to claim 1, wherein said mobile part slides on at least one lateral spindle of the locking means.

3. A folding clasp according to claim 1, characterized in that said locking means comprises a button firmly fixed to said mobile part.

4. A folding clasp according to claim 3, wherein said locking means comprises a guide part having an elongated opening in the first plane, said button having a portion arranged within said opening permitting guidance and maintaining in place of said button during the locking of said folding arms.

5. A folding clasp according to claim 4, wherein the locking means comprises a guide part permitting an initial locking of at least one cylindrical rod of said at least one folding arm with recesses of said guide part.

6. A wrist-watch having a folded clasp according to claim 1, wherein said clasp is attached to ends of a strap of said wrist-watch.

7. A folding clasp having at least one folding arm articulated with respect to a base plate, locking means placed on the base plate, said locking means comprising a mobile part permitting a locking with inclined end faces of said at least one folding arm by displacing said mobile part in a first plane substantially perpendicular to an opening/closing plane of said at least one folding arm, the locking comprising a guide part permitting an initial locking of at least one cylindrical rod of said at least one folding arm with recesses of said guide part.

8. A folding clasp according to claim 7, wherein the at least one cylindrical rod is located close to a fastening at an end of said at least one folding arm permitting an initial locking of the at least one cylindrical rod with the guide part prior to the locking of the inclined end face with said mobile part.

9. A folding clasp according to claim 8, wherein said at least one cylindrical rod is a thin-walled, elastic tube.

10. A folding clasp according to claim 9, wherein the at least one folding arm comprises a cover articulated with respect to said at least one folding arm and said cover is folded down onto the locking means permitting a locking security of said at least one folding arm.

11. A folding clasp according to claim 10, wherein said cover comprises an asymmetrical bottom, which is provided with a boss on a wide, conical side of said inclined end face corresponding to an unlocking position of the clasp and said asymmetrical bottom is recessed on a narrow, conical side of said inclined end face corresponding to a locking position of the clasp, so that when the cover is turned down said asymmetrical bottom of the cover maintains in place the button of the narrow, conical side of said inclined end face corresponding to a locking position of the clasp.

12. A folding clasp according to claim 10, wherein said cover is retained folded down by ratcheting with at least one fixing means located on one of a second folding arm and a base plate.

13. A folding clasp according to claim 12, wherein said at least fixing means comprises a box containing a ball located at the end of a rectilinear spring, said at least one fixing means being located within a guide bush of one of the second folding arm and the base plate, so that said ball projects beyond the guide bush and exerts a fixing force on the cover when the cover is folded down.

14. A folding clasp having at least one folding arm articulated with respect to a base plate, locking means placed on the base plate, said locking means comprising a mobile part permitting a locking with inclined end faces of said at least one folding arm by displacing said mobile part in a first plane substantially perpendicular to an opening/closing plane of said at least one folding arm, wherein the at least one folding arm comprises a cover articulated with respect to said at least one folding arm and said cover is folded down onto the locking means permitting a locking security of said at least one folding arm.

* * * * *